United States Patent [19]

March

[11] Patent Number: 4,843,654

[45] Date of Patent: Jul. 4, 1989

[54] RIDING PANTS

[76] Inventor: Marilou March, 485 Hidden La., Cherry Hill, N.J. 08034

[21] Appl. No.: 120,081

[22] Filed: Nov. 12, 1987

Related U.S. Application Data

[63] Continuation-in-part of Ser. No. 877,312, Jun. 23, 1986, abandoned.

[51] Int. Cl.[4] ..... A41D 1/06

[52] U.S. Cl. ..... 2/227; 2/228; 2/232; 2/272

[58] Field of Search ..... 2/227, 228, 232, 272, 2/97

[56] References Cited

U.S. PATENT DOCUMENTS

| | | | |
|---|---|---|---|
| D. 31,270 | 7/1899 | Jacob . | |
| D. 100,419 | 7/1936 | Fischer . | |
| D. 223,077 | 3/1972 | Benrube . | |
| D. 259,145 | 5/1981 | Inoue . | |
| D. 262,325 | 12/1981 | Miller . | |
| D. 267,674 | 1/1983 | Livernois . | |
| D. 270,204 | 8/1983 | Akens . | |
| D. 271,537 | 11/1983 | Alsup . | |
| D. 273,434 | 4/1984 | Galbreath . | |
| 1,571,016 | 1/1926 | Lesser | 2/228 |
| 1,771,916 | 7/1930 | Cowen . | |
| 1,885,527 | 11/1932 | Luft . | |
| 1,896,183 | 2/1933 | Manson | 2/227 X |
| 2,119,602 | 6/1938 | Roberts et al. . | |
| 2,146,494 | 2/1939 | Adamson | 2/228 |
| 2,316,588 | 4/1943 | Isaacs . | |
| 2,349,974 | 5/1944 | McMasters . | |
| 3,435,462 | 4/1969 | Bank | 2/227 |
| 3,800,330 | 4/1974 | Bowcut . | |
| 4,034,417 | 7/1977 | Ellis | 2/227 X |
| 4,569,874 | 2/1986 | Kuznetz | 2/272 X |

*Primary Examiner*—H. Hampton Hunter

*Attorney, Agent, or Firm*—Charles F. Duffield

[57] ABSTRACT

Cold weather riding pants are disclosed and are formed of a basic pants structure of a composite of an outer fabric, an intermediate layer of thermal insulation and an inner lining inside of the riding pants. A biaxially stretchable elastic insert is positioned along the outside side of each leg pant as well as in the upper portion of the seat of the pants. A frictional material insert is secured along the inside side of each leg pant together with an adjustable stirrup along the bottom of each leg pant. A pant leg zipper and/or an adjustable strap for gathering the lower portion of each leg pant is used to provide lower pant leg opening adjustment.

7 Claims, 3 Drawing Sheets

RIDING PANTS

This application is a continuation-in-part of application Ser. No. 877,312, filed June 23, 1986 and now abandoned.

BACKGROUND OF INVENTION

The present invention relates to riding pants and, more particularly, to riding pants for use in cold weather.

Typical riding pants are of a thin stretchable material that extend to midcalf. Such material is unsuitable for cold weather riding.

Riders in cold weather attempt to keep warm by wearing additional layers of clothing and/or thermal underwear. These additional layers of clothing become bulky and cumbersome.

In other instances, riders in cold weather wear leather chaps. Again, the chaps are heavy, bulky and cumbersome and thus undesirable.

Another effort utilized by riders in cold weather to stay warm is to utilize ski pants. The typical ski pants are of a smooth material and, while they do provide warmth, they are cumbersome and slippery and generally unsuited for riding.

What is required are riding pants that provide both the warmth required, formfitting while providing the freedom of movement of a typical riding pants while also providing for saddle grip and other riding apparel functions such as securing the lower pants leg in proper relationship to the riding boot.

SUMMARY OF INVENTION

The riding pants of the present invention overcome the shortcomings of conventional riding pants in cold weather riding by providing a riding pants having a pair of extending leg pants or leg portions which extend over the riding boot and which include a basic pants structure of an outer fabric, an intermediate layer of thermal insulation and an inner lining. The riding pants of the present invention further include an insert of biaxially stretchable elastic fabric along the outside or outer seam of each leg and in the upper portion of the seat of the pants to provide additional freedom of movement. Located along the inside side or inner seam of each leg is an insert of frictional material such as natural or artificial suede leather to provide grip upon the saddle.

Each lower portion or end portion of the leg pant of the riding pants of the present invention includes a zipper and/or an adjustable leg portion to provide an adjustable lower pant leg opening to facilitate drawing of the pant leg over a riding boot when pulling on the pants and then to secure the lower leg portion or end of each pant leg closely around the boot in use. Additionally, each lower leg pant or end includes an adjustable stirrup adapted to pass under the arch of the riding boot to maintain the leg pant in proper relation to the riding boot.

DETAILED DESCRIPTION OF INVENTION

Figure 1:
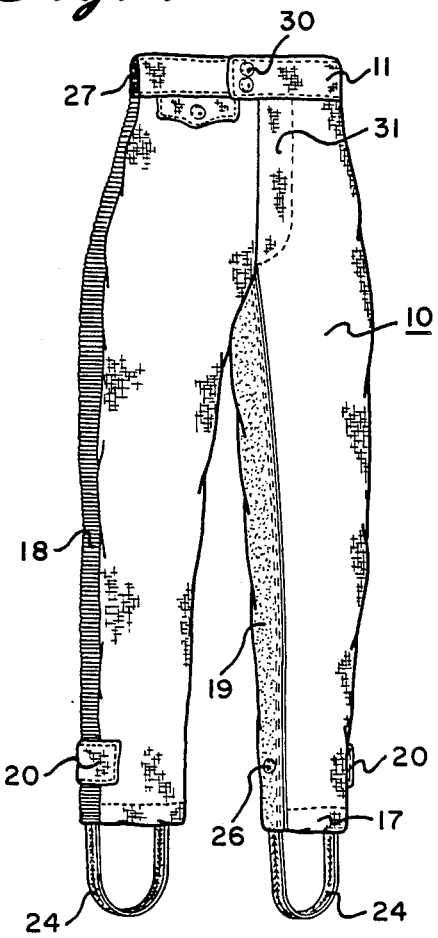
FIG. 1 is a front view of the riding pants of the present invention.
Figure 2:
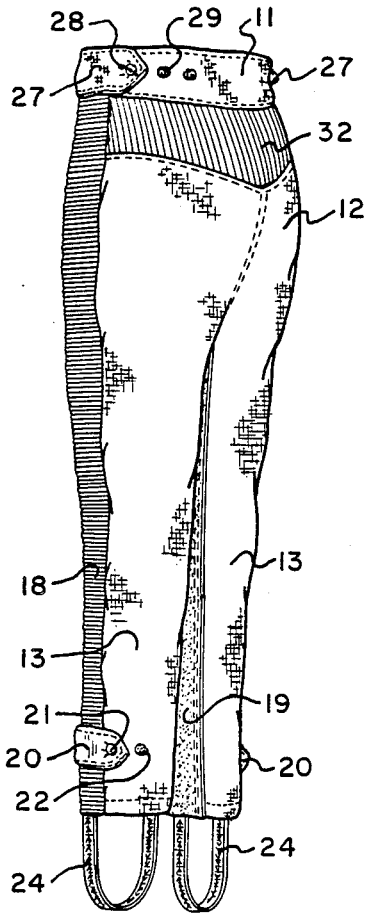
FIG. 2 is a rear view of the riding pants of the present invention.
Figure 4:
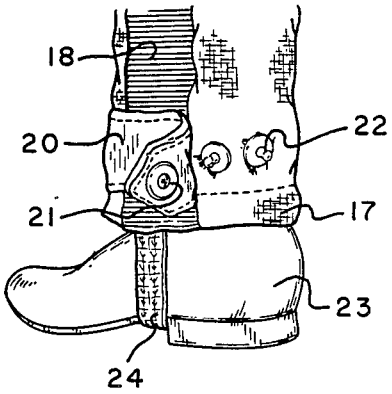
FIG. 4 is a side view of the lower portion of the left leg pant of the riding pants of the present invention.
Figure 5:
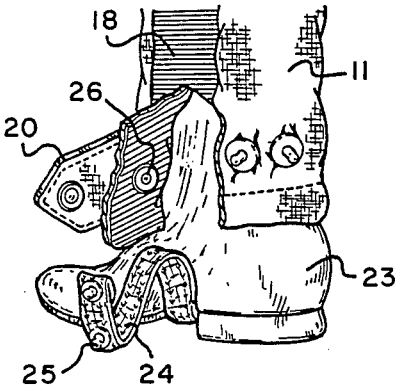
FIG. 5 is a side view of the lower portion of the left leg of the riding pants of the present invention partially in section to show the details of the leg strap.
Figure 6:
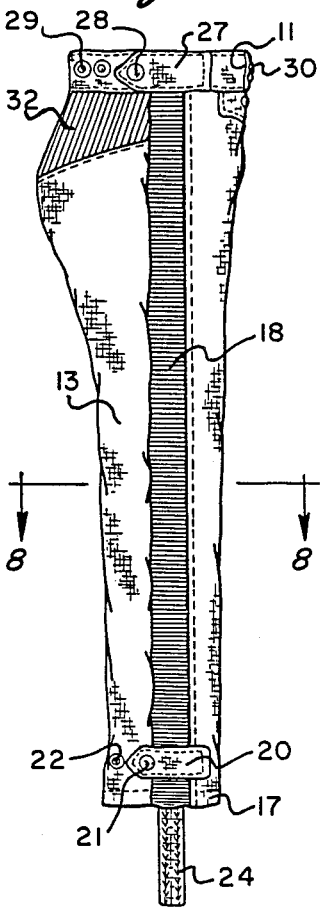
FIG. 6 is a right side view of the riding pants of the present invention.

The riding pants of the present invention are shown in FIGS. 1–9 of the drawings. Referring specifically to FIGS. 1, 2 and 6, the riding pants 10 include a waistband 11, a seat 12 and a pair of extending leg pants 13. As may be more specifically seen in FIG. 8, the basic structure of the riding pants of the present invention is a composite constructed of an outside layer of fabric 14, an intermediate layer of thermal insulation 15 and an inner lining 16. The outside fabric 14 may be of a durable material such as a combination of polyester and cotton. The intermediate layer of thermal insulation 15 is provided throughout the riding pants, except as hereafter noted, and is held in place between the outer fabric 14 and the intermediate layer of thermal insulation 15 by pants seam stitching through the riding pants. The intermediate layer of thermal insulation 15 may be a thermal insulating material such as a mat of cotton or a mat of high density polyester fibers commonly known as neddlepunch. The inner lining 16 may be of a durable and friction resistant smooth material such as nylon. This composite structure provides a durable and thermally insulating combination. The inner lining 16 and thermal insulation 15 extend throughout the entirety of the riding pants except in the areas of biaxially stretchable material which will be discussed immediately hereinafter.

Each pant leg has cut into the leg and extending from the waistband to the lower portion 17 of the pant leg a biaxially stretchable elastic fabric insert 18. The insert 18 may be of an elastic fabric material such as a double knit fabric. The insert 18 provides for flexibility of the riding pants and freedom of movement.

Figure 7:
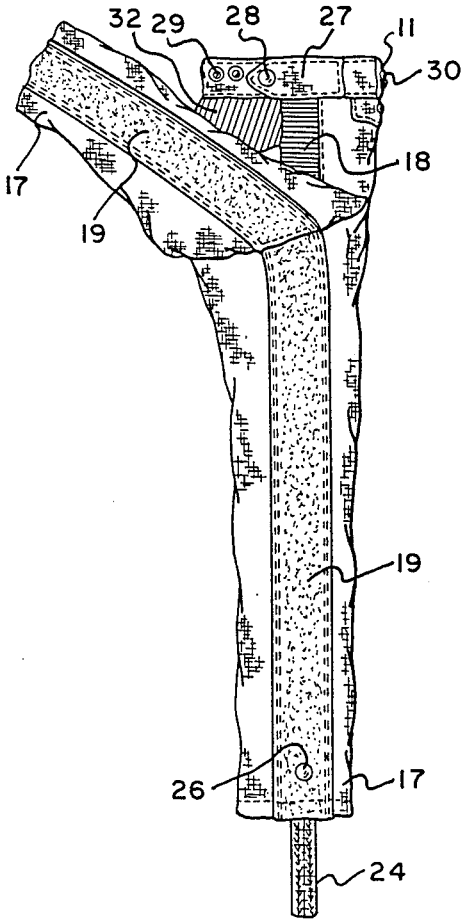
FIG. 7 is a right side view of the inside of the left leg of the riding pants of the present invention.
Figure 8:
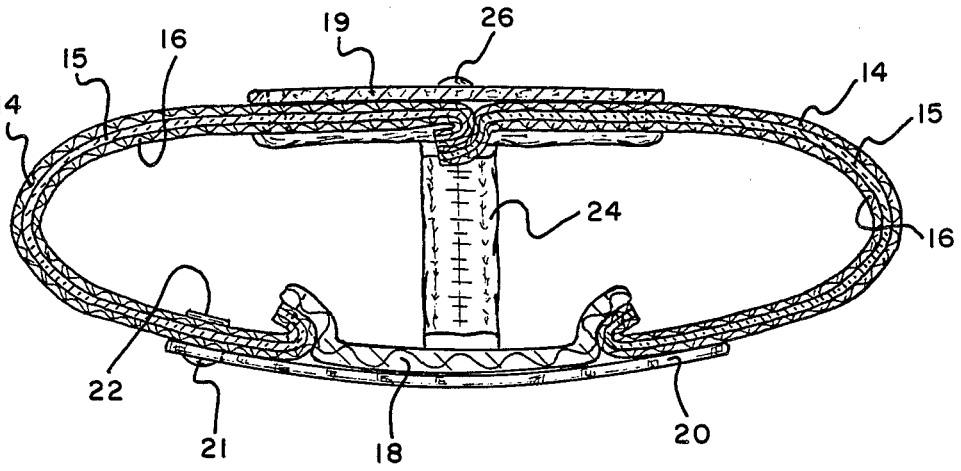
FIG. 8 is a sectional view of the right leg of the riding pants of the present invention taken along the lines 8—8 of FIG. 6.

As seen in FIGS. 1 and 2 and more specifically in FIG. 7, the riding pants of the present invention include a frictional material 19 extending along the entire length of the inside side of each leg pant from the crotch to the lower leg portion 17. This frictional material insert 19 may be of an imitation suede leather or real suede leather. The insert 19 provides for frictional grip of the saddle.

The lower leg portion 17 of each pant leg has means for variably adjusting the lower pant leg opening which includes an adjustable leg strap 20 as best shown in FIGS. 4 and 5. The leg strap 20 includes a snap 21 which can be adjustably interconnected with one of a plurality of snap posts 22 positioned around the lower portion of the leg pant 17. In this manner, the lower portion of the leg pant is held or gathered around the riding boot 23 and held firmly in place. This provides for both increased thermal protection and maintains the lower portion of the leg pant out of the way of the saddle stirrups.

Figure 9:
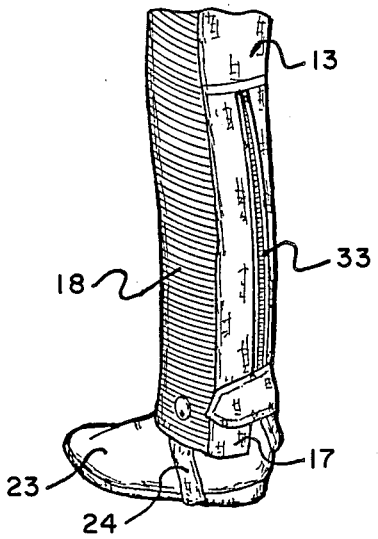
FIG. 9 is a side view of the lower portion of the left leg of the riding pants of the present invention showing an alternate embodiment of the means for adjustably varying the size of the lower leg pant opening including a leg strap and/or a zipper.

An alternate embodiment of the means for variably adjusting the lower pant leg opening is shown in FIG. 9. In this embodiment, a zipper is sewn into the rear of each lower leg portion 17 of the pant leg and extends from the pant leg opening to slightly above the calf of the leg. The zipper, when opened, aids in insertion of the riding boot through the pant leg and to secure the lower pant leg tightly around the boot when closed. The adjustable leg strap 20 may also be used in conjunction with the zipper 33 as shown in FIG. 9.

Further as best shown in FIGS. 4 and 5, the lower portion of each pant leg 17 includes an adjustable stirrup 24. The stirrup 24 includes a plurality of posts 25 which cooperate with a snap 26 located on the inside of the outside lower leg portion 17. A similar plurality of posts and a snap (not shown) are provided for the opposite end of the stirrup 24 on the inside lower leg portion. Appropriate adjustment of the position of the stirrup 24 with respect to the posts and snaps provides proper tension upon the pant leg when the stirrup is positioned under the arch of the riding boot to thus maintain the pant leg down firmly over the riding boot.

Figure 3:
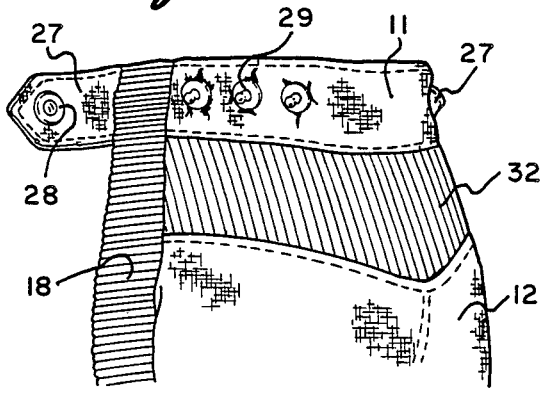
FIG. 3 is a top rear view of the riding pants of the present invention.

Referring to FIGS. 1–3 and FIG. 6 and, more specifically FIG. 3, the waistband 11 has an adjustable strap 27 with an included snap 28. The snap 28 cooperates with a plurality of posts 29 on the left side to provide an adjustable waistband. This arrangement is provided on both the left side and right side of the riding pants as shown in FIGS. 3 and 6 respectively.

A conventional snap and post combination 30 is provided in the front of the riding pants. A front zipper and flap combination 31 is likewise provided to permit the riding pants to be put on and secured in place.

As more specifically shown in FIG. 3, the upper portion of the seat 12 of the riding pants of the present invention includes an insert 32 in the upper portion thereof formed of a biaxially stretchable elastic fabric cut into the seat 12. This material is the same as the inserts 18 in the legs of the riding pants. The biaxially stetchable elastic fabric provides for freedom and flexibility of the upper portion of the seat for freedom of movement.

From the foregoing description of a specific embodiment of the riding pants of the present invention, it will be appreciated that the riding pants provide both for warmth, freedom of movement, saddle grip and other riding apparel functions such as securing of a lower pant leg in proper relationship to the riding boot which in combination has not heretofore been provided in any riding apparel.

The riding pants of the present invention have been described in respect to a specific embodiment thereof disclosed in the drawings. Other modifications and variations thereof will be apparent to those of ordinary skill in the art by reason of the foregoing description of the invention in respect to a specific embodiment thereof. Accordingly, no limitation as to the scope of the invention is intended by the disclosure of a specific embodiment thereof but the scope of the invention is to be interpreted in view of the appended claims.

What is claimed is:

1. In fabric riding pants having a waistband, seat and a pair of extending leg portions terminating in leg portion openings, the improvements providing for cold weather riding comprising:

an intermediate layer of thermal insulation and an inner lining thereupon positioned and secured internally of the riding pants providing for thermal insulation;

an insert of biaxially stretchable elastic fabric cut into and extending along the outer seam of each leg portion providing for freedom of movement; and an insert of frictional material extending along the inner seam of each leg portion to provide saddle grip.

2. The riding pants of claim 1 further including an adjustable stirrup extending from the bottom of each leg portion adapted to engage a riding boot and within the leg portion in place.

3. The riding pants of claim 1 further including means for variably adjusting each leg portion opening.

4. The riding pants of claim 3 wherein the means for variably adjusting each leg portion opening includes an adjustable leg strap at the lower end of each leg portion for gathering the leg portion about a riding boot.

5. The riding pants of claim 1 further including an insert of biaxially stretchable elastic material cut into the upper portion of the seat of the riding pants to provide freedom of movement.

6. The riding pants of claim 2 further including means for variably adjusting each leg portion.

7. The riding pants of claim 6 further including an insert of biaxially stretchable elastic material cut into the upper portion of the seat of the riding pants to provide freedom of movement.

* * * * *